United States Patent [19]

Deal et al.

[11] Patent Number: 4,729,907

[45] Date of Patent: Mar. 8, 1988

[54] METHOD OF MAKING A VIEWING SCREEN STRUCTURE FOR A CATHODE-RAY TUBE

[75] Inventors: Samuel B. Deal; Richard A. Lambert, both of Manheim Township, Lancaster County, Pa.

[73] Assignee: RCA Corporation, Princeton, N.J.

[21] Appl. No.: 17,726

[22] Filed: Feb. 24, 1987

[51] Int. Cl.[4] ..... B05D 5/06

[52] U.S. Cl. ..... 427/64; 427/68; 427/236; 427/314; 427/407.2; 427/421; 427/424; 427/427

[58] Field of Search ..... 427/64, 236, 314, 407.2, 427/424, 427, 421, 68

[56] References Cited

U.S. PATENT DOCUMENTS

| | | | |
|---|---|---|---|
| 2,987,415 | 6/1961 | Taggett | 427/64 |
| 3,423,621 | 1/1969 | Royce | 313/92 |
| 3,652,323 | 3/1972 | Smith | 427/64 |
| 3,703,401 | 11/1972 | Deal et al. | 117/33.5 |
| 3,811,926 | 5/1974 | Smith | 427/64 |
| 4,025,661 | 5/1977 | Moscony et al. | 427/68 |
| 4,623,820 | 11/1986 | Deal et al. | 313/466 |

*Primary Examiner*—Janyce A. Bell

*Attorney, Agent, or Firm*—Eugene M. Whitacre; Dennis H. Irlbeck; Vincent J. Coughlin, Jr.

[57] ABSTRACT

An aluminized viewing screen structure for a cathode-ray tube includes a faceplate panel having a barrier coating and a heat absorptive overcoating comprising a plurality of layers overlying the aluminum metal layer. The barrier coating and the overcoating are applied to the panel which is preheated to accelerate drying of the barrier coating and the overcoating. The novel process includes (a) tilting the preheated panel to a 60°±10° angle relative to a horizontal plane, (b) loading the tilted panel onto a carrier, (c) and advancing the carrier by means of a conveyor in a first direction, through a spray assembly. A plurality of spray guns are mounted on a reciprocating device which moves up and down, that is, in a second and a third direction which is different from the direction of motion of the conveyor. The spray guns are directed substantially perpendicular to the faceplate panel. One of the spray guns is activated and deactivated to deposit a barrier coating of a volatilizable film-forming material on the aluminum metal layer. The remaining guns are sequentially activated and deactivated to deposit on the barrier-coated metal layer a heat absorptive overcoating comprising a plurality of layer. The conveyor can be reversed after the carrier and panel exit the spraying assembly and the carrier and panel can be transported through the spray assembly in a fourth direction which is opposite to the first direction. During the reverse transit of the carrier and the panel through the spray assembly, the spray guns are once again activated and deactivated to provide additional plural layers of the heat absorptive overcoating.

5 Claims, 7 Drawing Figures

METHOD OF MAKING A VIEWING SCREEN STRUCTURE FOR A CATHODE-RAY TUBE

BACKGROUND OF THE INVENTION

The invention relates to a novel method for making a viewing screen structure for a cathode-ray tube and more particularly to a method for depositing a barrier coating and a plurality of coatings layers of a heat absorptive material on a metal layer overlying the viewing screen.

One type of cathode-ray tube that is used for television displays is referred to as a shadow-mask tube. This tube is comprised of an evacuated envelope having a viewing window, a viewing-screen structure comprised of a mosaic of phosphor areas (usually dots or strips) of different emission colors supported on the inner surface of the viewing window, a shadow mask having an array of apertures therein in register with the phosphor areas mounted in the tube in adjacent spaced relation with the window, and means for projecting one or more (usually three) electron beams towards the screen for selectively exciting the phosphor areas thereof.

In operating a shadow-mask tube, the electron beams are made to scan a raster in a fixed pattern. As the beams are made to scan, they are either intercepted by the mask or they pass through the mask apertures and excite the desired phosphor areas. The energy in the intercepted electron beams heats the mask and causes the mask to become distorted, which may adversely affect the position of the beams which pass through the mask apertures. Some of the heat in the mask is removed by radiation back to a dark coating on the funnel of the tube. Normally, the viewing-screen structure includes a thin layer of a highly reflective metal, usually aluminum, which reflects heat that is radiated forward towards the screen.

U.S. Pat. No. 3,703,401 issued to S. B. Deal et al. on Nov. 21, 1972 and U.S. Pat. No. 4,025,661 issued to J. J. Moscony et al. on May 24, 1977 suggest applying to the reflective metal layer on the viewing screen a water based heat-absorptive overcoating of carbon particles. U.S. Pat. No. 4,623,820 issued to S. B. Deal et al. on Nov. 18, 1986 suggests that silica particles be added to the carbon particle overcoating as a binder therefor. The viewing screen structure is baked to remove organic and volatile materials therefrom. The purpose of a heat-absorptive overcoating is to promote the transport of heat from the shadow mask to the atmosphere through the glass panel and thereby reduce mask warpage due to uneven heating of the mask-frame assembly of the tube. Common formulations used in applying these overcoatings include such constituents as finely-divided particles of graphite, lamp black and silica together with dispersants and wetting agents.

The Deal et al. and Moscony et al. patents suggest air spraying the overcoating as well as an initial sealer coating or barrier layer which prevents carbon in the overcoating from penetrating through the aluminum metal layer into the phosphor mosaic. The patents also suggest the use of a suitable shield to prevent the barrier layer and the overcoating from being sprayed on the inner sidewall of the panel and onto the seal land. It is necessary to prevent the coatings from contacting the seal land since contaminants on the seal land will adversely affect the quality of the subsequent frit seal which is required to attach the faceplate panel to the funnel portion of the tube.

As described in copending U.S. patent application Ser. No. 936,500 filed on Dec. 1, 1986 by S. B. Deal and assigned to the assignee of the present invention, the panel may be positioned horizontally during the spray step with the guns positioned below the panel. Alternatively the spray guns may be located above the horizontally disposed panel or the guns may be located at one side of a vertically disposed panel.

In U.S. Pat. Nos. 3,703,401, 4,025,661 and 4,623,820 only one gun is used to spray the barrier coating and about 10 passes of the spray across the surface are required to obtain a satisfactory barrier coating. The sprayed barrier coating typically requires 1 to 3 minutes of air spraying with an air-spray gun operating at about 50-pounds-per-square-inch pressure. The sprayed barrier coating dries in less than a minute, due in part to the heat in the preheated panel. Then, with the panel still preheated above 50° C., the carbon-containing overcoating is sprayed on the previously barrier-coated metal layer. The spraying is conducted for about 2 to 5 minutes with an air-spray gun operating at about 50 pounds-per-square-inch pressure and includes about 20 passes to provide a coating weight of about 0.15 $mg/cm^2$. The sprayed material dries in less than a minute due in part to the heat in the preheated panel, and forms a heat absorptive overcoating.

A problem with the above-described spraying processes is that the time required to spray the barrier coating and the overcoating is unacceptably long. Additionally, greater coating uniformity is required than has previously been obtained.

SUMMARY OF THE INVENTION

An aluminized viewing screen structure for a cathode-ray tube includes a faceplate panel having a barrier coating and multiple coatings a heat absorptive overcoating in contact with the aluminum metal layer as in the prior art. The barrier coating and the overcoating are applied to the panel which is preheated to accelerate drying of the barrier coating and the overcoating. The novel process includes (a) tilting the preheated panel to a $60° \pm 10°$ angle relative to a horizontal plane, (b) loading the tilted panel onto a carrier, (c) and advancing the carrier by means of a transport device in a first direction through a spray assembly having a plurality of spray guns mounted on a reciprocating device which is parallel to the carrier. The reciprocating device moves the spray guns in a direction different from the direction of the transport device. One of the spray guns is activated to deposit the barrier coating, which comprises a volatilizable film-forming material, on the aluminum metal layer. The one spray gun is deactivated and the remaining spray guns are sequentially activated and deactivated to deposit on the barrier-coated metal layer multiple coatings a heat absorptive overcoating.

DETAILED DESCRIPTION OF THE PREFERRED EMBODIMENT

Figure 1:
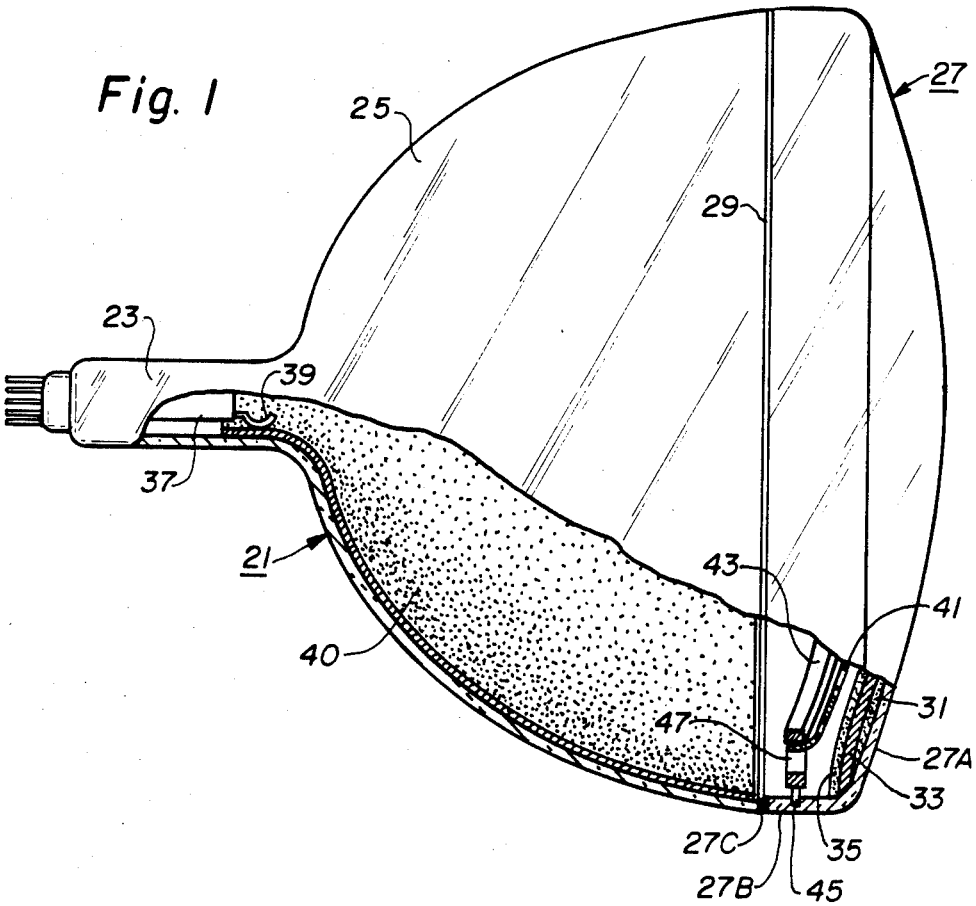
FIG. 1 is a partially broken-away longitudinal view of a cathode-ray tube made according to the novel method.

The CRT shown in FIG. 1 is an aperture-mask-type kinescope of the type described in U.S. Pat. No. 3,423,621 to M. R. Royce. The CRT includes an evacuated envelope 21, which includes a neck 23 integral with a funnel 25 and a faceplate panel 27. The faceplate panel 27 comprises a viewing window 27A and an integral peripheral sidewall 27B which terminates in a seal land 27C and which is joined to the funnel 25 by a seal 29 of devitrified glass. A luminescent viewing screen 31 comprising a mosaic of line or dot areas of different luminescent emission colors resides on the inner surface of the viewing window 27A. A light-reflecting metal layer 33 of aluminum resides on the screen 31, and a heat absorptive overcoating 35 resides on the metal layer 33. An electron-gun mount assembly 37 is located in the neck 23. A plurality of metal fingers 39 (only one of which is shown) space the mount assembly 37 from the neck wall and connect the mount assembly 37 to an internal conductive coating 40 on the inner surface of the funnel 25. Closely spaced from the metal layer 33 is a metal aperture mask or shadow mask 41. The mask 41 is welded to a metal frame 43 which is supported by springs 47 on studs 45 which are integral with the panel 27. An electron beam or beams from the mount assembly 37, when suitably scanned on the screen 31, is capable of producing a luminescent image which may be viewed through the window 27A.

Figure 2:
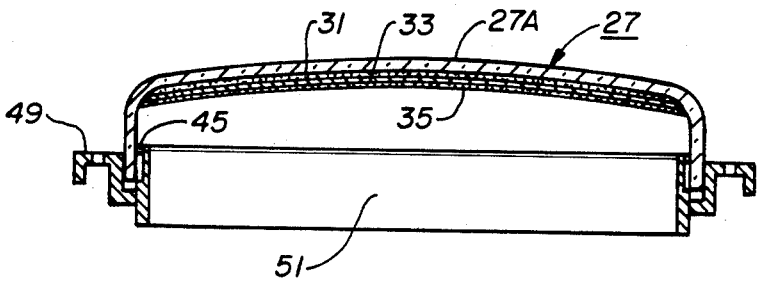
FIG. 2 is a side sectional view of a faceplate panel mounted on a spray shield during a step in the manufacturing process.

The heat absorptive overcoating 35 which overlies the metal layer 33 may comprise any of the heat absorptive coatings described in U.S. Pat. Nos. 3,703,401; 4,025,661 or in 4,623,820, which are incorporated by reference herein. In order to apply the overcoating 35, a spray shield 49, shown in FIGS. 2, 3 and 4, and described in copending U.S. patent application Ser. No. 936,500 filed by S. B. Deal on Dec. 1, 1986, is used to prevent the overcoating 35 from contaminating the seal land 27C. The shield 49 has a substantially rectangular, centrally disposed spray aperture 51 therethrough. The copending Patent Application Ser. No. 936,500, which is assigned to the assignee of the present invention and incorporated by reference herein, describes the application of a barrier coating and an overcoating to a preheated faceplate panel using a barrier spray gun and a plurality of overcoating spray guns disposed below the panel and directed upward. It has been determined that this orientation of the faceplate panel and spray guns causes a non-uniform barrier coating and overcoating. The non-uniformity is caused by barrier coating or overcoating particles or droplets which fall by gravity and are blown back onto the metal layer of the faceplate by the upwardly directed spray.

Figure 3:
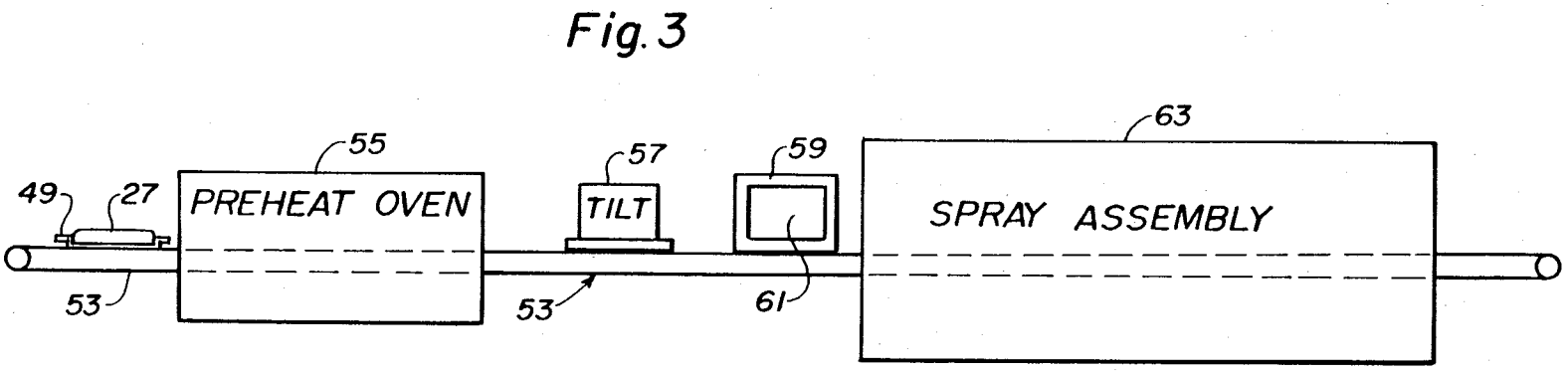
FIG. 3 is a block diagram showing the equipment used to perform the novel method.
Figure 4:
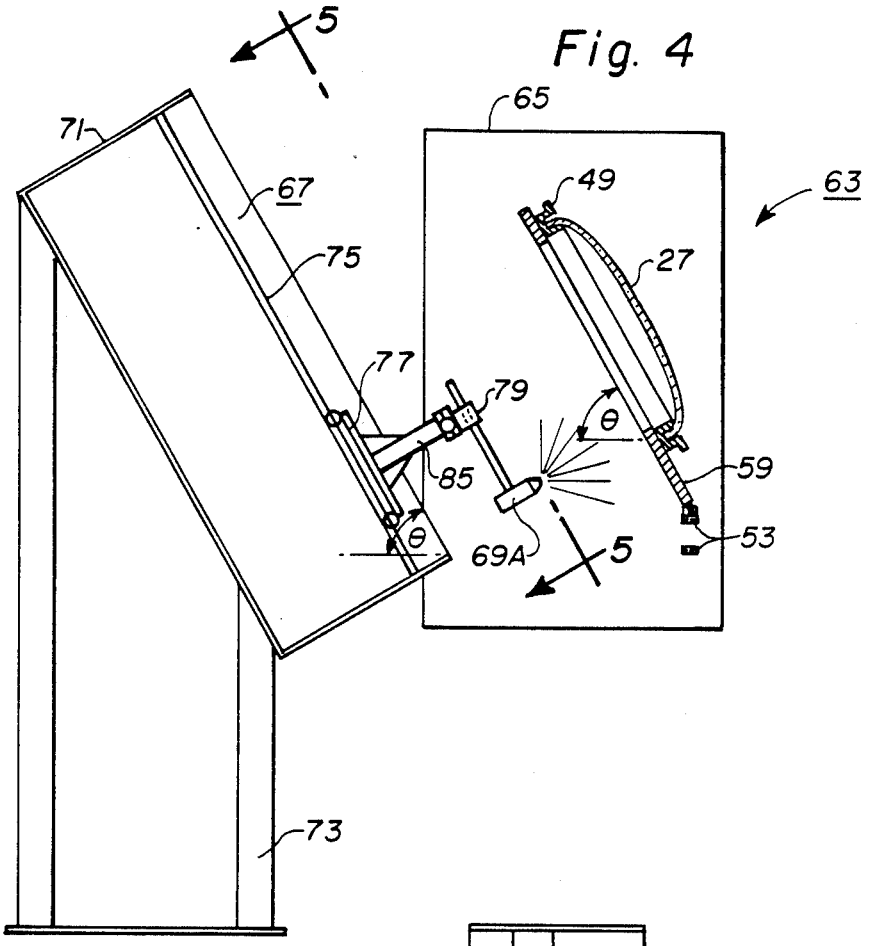
FIG. 4 is a side view of a spray booth.
Figure 5:
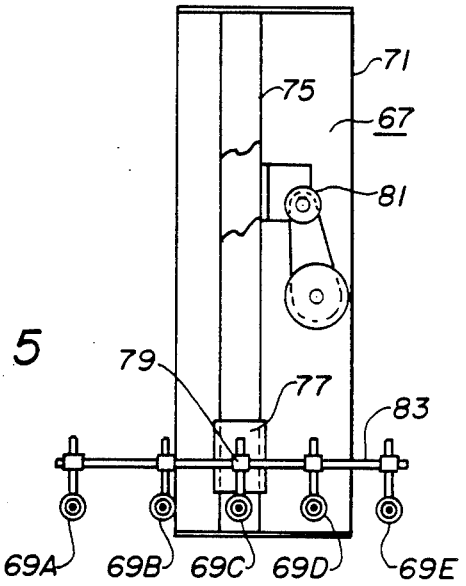
FIG. 5 is a plan view of a reciprocating device used in the present invention.

The novel process is similar to the prior process described in the copending Patent Application Ser. No. 936,500 except as indicated hereinafter. With reference to FIGS. 3–5, a faceplate panel 27 having an aluminum metal layer (not shown) overlying a luminescent viewing screen (also not shown) is loaded onto a spray shield 49. The spray shield 49 and the panel 27 are placed onto an indexing, panel-preheat-oven feed conveyor 53 which moves in a horizontal plane and acts as a transport device for conveying the spray shield 49 and the panel 27 into a panel-preheat-oven 55. The oven 55 operates at a temperature of about 135° C. to provide a panel temperature, at spraying, of about 70° C. to 85° C. The heated spray shield 49 and panel 27 are transported from the oven 55, by conveyor 53, to a tilt station 57. The heated spray shield 49 and the panel 27 are tilted at an angle, $\theta$, of about $60° \pm 10°$ relative to the horizontal plane for a reason that will be explained hereinafter. The tilted spray shield 49 and panel 27 are loaded onto a carrier 59 which retains the spray shield and panel in the tilted orientation during spraying. The carrier 59 has a large opening 61 therein to permit the subsequently sprayed materials to pass therethrough onto the metal layer 33 overlying the viewing screen 31. The carrier 59 is fixed to the conveyor 53 so that the carrier with the spray shield 49 and panel 27 thereon advance through a spray assembly 63 at a constant speed.

The spray assembly 63 comprises an enclosure or spray booth 65, through which the conveyor 53 and the carrier 59 pass, a reciprocating carriage assembly 67, carrying a plurality of air spray guns 69A, 69B, 69C, 69D and 69E, a carriage support 71 and a carriage support base 73. The carriage support 71 is mounted at an angle, $\theta$, of about $60° \pm 10°$ relative to the horizontal plane so that the reciprocating carriage assembly 67 is substantially parallel to the carrier 59 having the spray shield 49 and the panel 27 thereon. The reciprocating carriage assembly 67 comprises a carriage track 75, a rolling carriage 77, a spray gun support assembly 79 and a drive mechanism 81. The spray gun support assembly 79 includes a first support bar 83 to which each of the spray guns 69A–69E is attached and a second support bar 85 which is secured at one end to the rolling carriage 77 and at the other end to the first support bar 83. The drive mechanism 81 moves the rolling carriage 77 along a portion of the inclined carriage track 75 so that the spray guns 69A–69E move transverse, i.e. up and down, relative to the direction of travel of the tilted carrier 59. Each of the spray guns 69A–69E is disposed substantially perpendicular to the plane of the carrier 59 and the faceplate 27.

The spray gun 69A sprays an aqueous dispersion of a volatilizable film-forming material upon the aluminum metal layer 33 to form a barrier layer (not shown) to prevent subsequently deposited carbon particles from entering the pores in the aluminum metal layer and passing to the phosphor of the viewing screen. A preferred dispersion that is substantially free from substances which, when incinerated, yield metal-ion-containing residues is prepared by mixing 250 milliliters of an aqueous acrylic resin emulsion (containing about 46 weight-percent solids) and 14 grams PVP (polyvinylpyrolidone) with 2050 milliliters of deionized water. A preferred acrylic resin emulsion is Rhoplex AC-234 marketed by Rohm and Haas Company, Philadelphia, PA. The spray gun 69A operates at about 50 pounds-per-square inch pressure. The spray guns 69B–69E each spray a suspension containing at least carbon particles onto the barrier coating deposited from gun 69A to form a heat absorptive overcoating. A preferred coating has the following formulation:

50.36 liters (88.67 weight-percent) of deionized water;

22.8 grams (0.04 weight-percent) wetting agent, such as Brij 35 marketed by ICI America Inc., Wilmington, Del., 114 grams (0.2 weight-percent) dispersant, such as Marasperse CBX-2 marketed by Reed Lignin Company, Rothschild, Wisc., 5160 grams (9.09 weight-percent) colloidal graphite such as Aqua Dag E (22% solids) marketed by Acheson Colloids Company, Port Huron, Mich., 1140 grams (2 weight-percent) amorphous carbon such as Vulcan XC-72 marketed by Cabot Corporation, Boston, Mass.

Alternative formulations for the heat absorptive material are disclosed in the aforementioned U.S. Pat. Nos. 3,703,401, 4,025,661 and 4,623,820. Each of the spray guns 69B–69E operates at about 50 pounds-per-square inch pressure.

Figure 6:
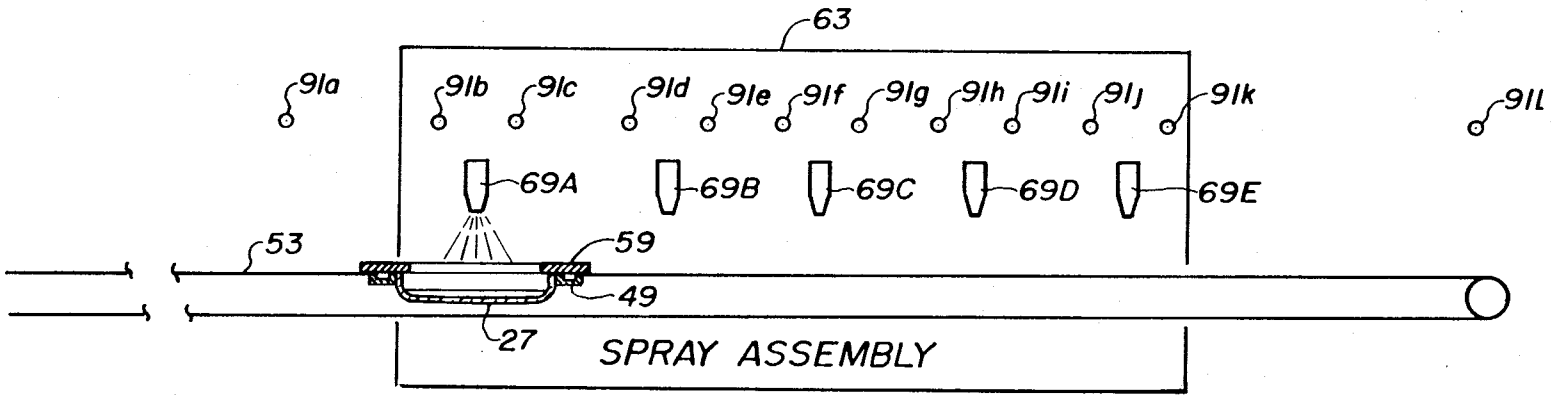
FIG. 6 is a schematic diagram showing the layout of the spray assembly used in the present invention.
Figure 7:
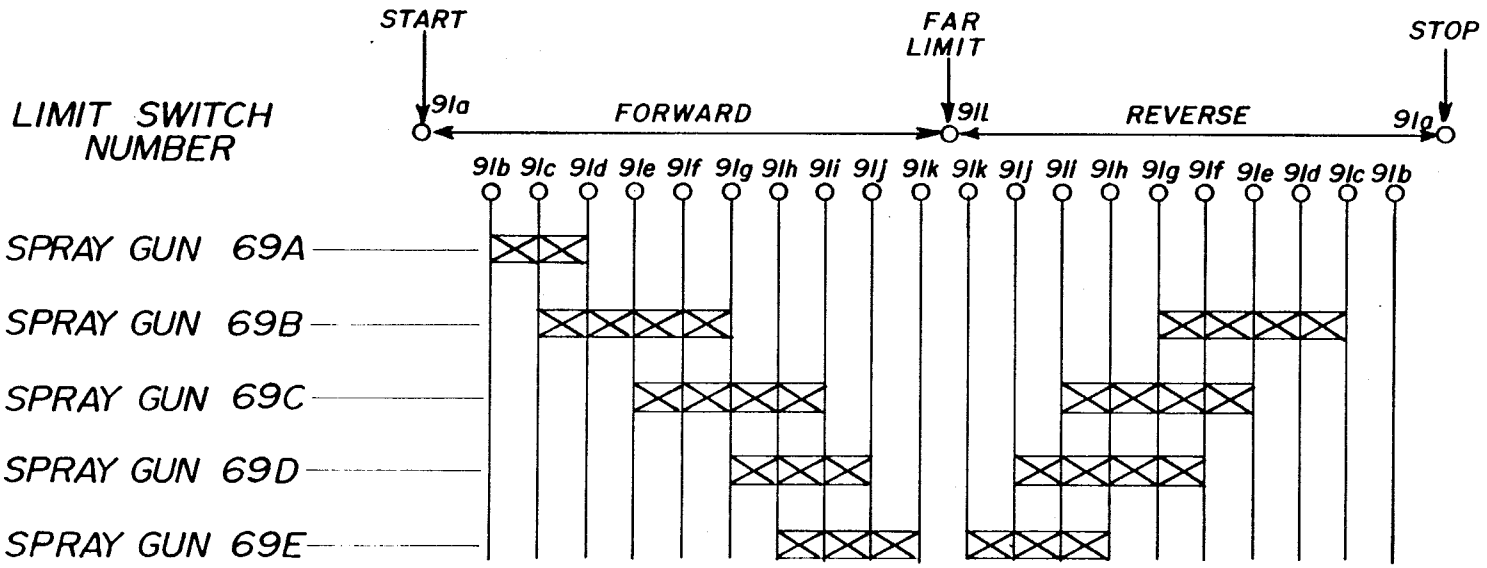
FIG. 7 is a TABLE showing the sequence for spraying a barrier coating and plural overcoating layers according to the layout of FIG. 6.

The sequence of spray steps can be understood with the aid of FIGS. 6 and 7. For convenience in FIG. 6, the panel 27, spray shield 49 and carrier 59 are shown as being horizontally disposed on the conveyor 53 and below the spray guns 69A–69E, rather than being tilted at a 60°±10° angle relative to the horizontal plane and above the spray guns which is the preferred orientation. As the carrier 59 passes a first limit switch **91*a* and enters the spray assembly 63 a second limit switch 91*b* is tripped and spray gun 69A is activated. The spray gun 69A, attached to the reciprocating carriage assembly 67 (FIGS. 4 and 5) travels up and down on the track 75 while depositing a barrier coating (not shown) of the volatilizable film-forming material on the metal layer of the faceplate 27. The gun 69A has a vertical sweep speed of about 1 sweep per second and travels about 24 inches in each direction. The panel 27 has a 27 inch diagonal dimension and a rectangular screen size of about 21.3 inch by 16 inch. The horizontal rate of advance of the conveyor 53 is about 20 feet per minute. As the carrier 59 passes a limit switch 91*c*, the limit switch 91*c* is tripped and the spray gun 69B is activated. As the carrier 59 passes the limit switch 91*d*, the spray gun 69A is deactivated. Typically, the spacing between the spray gun 69A and the spray gun 69B is about 18 inches. The time required for the panel 27 to travel between the adjacent spray guns 69A and 69B and the heat in the panel 27 permit the barrier coating to dry before the overcoating from the spray gun 69B is applied to the panel. As shown in FIG. 7, the spray gun 69B is activated when the limit switch 91*c* is tripped and is deactivated by the tripping of a limit switch 91*g*. When the spray gun 69B is activated, an overcoating layer 35 of a heat absorptive material is deposited on the dried barrier-coated metal layer. The spray gun 69C is activated when the carrier 59 trips a limit switch 91*e* and another overcoating layer 35 of the heat absorptive material is deposited on the overcoating layer from the spray gun 69B. As the carrier 59 passes between the limit switches 91*e* and 91*g*, the spray guns 69B and 69C are both activated to spray different portions of the panel 27. The spray gun 69B is deactivated when the carrier 59 passes the limit switch 91*g* and the spray gun 69D is activated at that position. Between the limit switches 91*g* and 91*i*, both of the spray guns 69C and 69D are activated and at a limit switch 91*h* the spray gun 69E is also activated so that plural layers of the heat absorptive overcoating 35 are being sprayed, simultaneously, on different portions of the previously deposited overcoating layers to build-up the thickness of the overcoating. As the carrier 59 passes the limit switches 91*i*, 91*j* and 91*k*, the spray guns 69C, 69D and 69E, respectively, are sequentially deactivated. The spray guns 69B–69E are spaced about 15 to 16 inches apart to provide total coverage while allowing each previously deposited layer of overcoating 35 to dry, aided by the residual heat in the panel, before the next layer of overcoating is sprayed thereon. After passing the limit switch 91*k*, the carrier 59 with the spray shield 49 and panel 27 thereon exits the spray assembly 63 and contact a far limit switch 91L**.

According to the present method, the activation of the limit switch 91L reverses the direction of the conveyor 53 and moves the carrier 59, the spray shield 49 and the panel in the opposite direction through the spray assembly 63. As shown in FIGS. 6 and 7, the carrier 59 contacts the limit switches **91*k*, 91*j*, 91*i* and 91*g* in that order to sequentially activate the spray guns 69E, 69D, 69C and 69B to deposit additional plural coatings of heat absorptive overcoating 35 onto the previously deposited coatings. Deactivation of the spray guns 69E, 69D, 69C and 69B is accomplished by the carrier 59 tripping the limit switches 91*h*, 91*f*, 91*e* and 91*c*, respectively. The carrier 59, the spray shield 49 and the panel 27, having the plural layers of overcoating 35 thereon, exit the spray assembly 63 at the end at which they initially entered the spray assembly. The spray shield 49 and the panel 27 are then unloaded from the carrier 59 and the cycle is repeated for the next panel. The coated panel is now processed in the usual way. This includes the usual step of baking the panel in air at about 400° to 500° C. to remove, by vaporization and oxidation, the volatile and organic matter in the structure. In this last baking step, the film and coating of volatilizable material underlying the aluminum metal layer, the binders in the mosaic viewing screen, and all the dispersing agents and wetting agents in the structure also are removed. After baking, the structure includes the aluminum-metal reflective layer 33 on the phosphor mosaic viewing screen 31 and the heat absorptive overcoating 35** adhered upon the aluminum layer:

GENERAL CONSIDERATIONS

There are many variations that may be made to the preferred embodiment that fall within the scope of the novel method. For example, the conveyor speed, the speed of the reciprocating carriage assembly and the spray gun pressures can be varied from that disclosed herein to obtain a coating weight for the heat absorptive overcoating 35 that is different from the preferred weight of 0.15 mg/cm$^2$. Alternatively, the panel can be unloaded adjacent to the far limit switch 91L, after it makes a single transit through the spray assembly 63. The tilting of the panel 27 at a 60°±10° angle and the location of the spray guns 69A–69E substantially perpendicular to the surface of the panel, ensures that any droplets or particles from the spray guns will fall away from the panel and the spray guns without causing either runs of the sprayed materials on the metal layer 33 of the panel, or blemishes resulting from a blow-back of particles or droplets caught in the spray streams.

What is claimed is:

1. In a method of making a viewing screen structure for a cathode-ray tube having a faceplate panel, a viewing screen on a portion thereof and a metal layer on said viewing screen, the steps subsequent to producing said metal layer comprising (A) preheating said panel in a preheat oven, (B) conveying said heated panel to a tilt station by means of a transport device.

(C) tilting said panel to a 60°±10° angle relative to a horizontal plane.

(D) loading said tilted panel onto a carrier.

(E) advancing said carrier and said guns being perpendicular to said panel by means of said transport device in a first direction through a spray assembly including a spray booth and a plurality of spray guns mounted on a reciprocating device which is parallel to said carrier, said reciprocating device moving said spray guns in a second and a third direction, said second and third direction being different from said first direction, (F) activating and deactivating one of said spray guns to deposit on said metal layer a barrier coating of a volatilizable film-forming material.

(G) and sequentially activating and deactivating the remaining spray guns to deposit on the barrier-coated metal layer multiple coatings of a heat absorptive overcoating.

2. The method as described in claim 1 including the additional steps, after step (G) of (i) reversing said transport device to move said carrier through said spray assembly in a fourth direction opposite to said first direction, (ii) sequentially activating and deactivating said remaining spray guns to deposit, on said heat absorptive overcoating an additional plurality of coatings of heat absorptive material, (iii) exiting said spray assembly, (iv) and then, unloading said panel from said carrier.

3. In a method of making a viewing screen structure for a cathode-ray tube having a faceplate panel, a viewing screen on a portion thereof and a metal layer on said viewing screen, the steps subsequent to producing said metal layer comprising (a) preheating said panel in a preheat oven, (b) conveying said heated panel to a tilt station by means of a transport device.

(c) tilting said panel to a 60°±10° angle relative to a horizontal plane, (d) loading said tilted panel onto a carrier, (e) advancing said carrier by means of said transport device in a first direction through a spray assembly including a spray booth and a plurality of spray guns mounted on a reciprocating device which is parallel to said carrier, said guns being substantially perpendicular to said panel, said reciprocating device moving said spray guns in a second direction different from said first direction.

(f) activating and deactivating one of said spray guns to deposit on said metal layer a barrier coating of a volatilizable film forming material, (g) and sequentially activating and deactivating the remaining spray guns to deposit on the barrier-coated metal layer multiple coatings of a heat absorptive overcoating comprising a plurality of layers (h) exiting said spray assembly with said carrier and reversing said transport device to move said carrier in a third direction, opposite said first direction through said spray booth, (i) sequentially activating and deactivating said remaining spray guns to deposit, on said heat absorptive overcoating an additional plurality of coatings of heat absorptive material, (j) exiting said spray assembly, (k) and then, unloading said panel from said carrier.

4. A method of making a viewing screen structure for a cathode-ray tube having a faceplate panel, a viewing screen on a portion thereof and a metal layer on said viewing screen, the steps subsequent to producing said metal layer comprising (A) loading said panel onto a spray shield.

(B) placing said spray shield and said panel onto a transport device moving in a horizontal plane.

(C) conveying said spray shield with said panel thereon into a preheated oven.

(D) transporting said heated spray shield and said panel to a tilt station.

(E) tilting said heated spray shield and said panel to a 60°±10° angle relative to said horizontal plane.

(F) loading said tilted spray shield and said panel onto a carrier.

(G) advancing said carrier in a first direction into a spray assembly including a spray booth and a plurality of spray guns mounted on a reciprocating device which is parallel to said carrier, said reciprocating device moving said spray guns in a second direction and an opposed third direction, said second and third directions being different from said first direction, said spray guns being substantially perpendicular to said panel.

(H) activating and deactivating one of said spray guns to deposit on said metal layer a barrier coating of a volatilizable film-forming material.

(I) and sequentially activating and deactivating the remaining spray guns to deposit on a barrier-coated metal layer multiple coatings of a heat absorptive overcoating.

5. The method as described in claim 4, including the additional steps, after step (I) of (i) reversing said transport device to move said carrier through said spray assembly in a fourth direction, said fourth direction being opposite said first direction.

(ii) sequentially activating and deactivating said remaining spray guns which deposit on said heat absorptive overcoating an additional plurality of coatings of heat absorptive material, (iii) exiting said spray assembly, (iv) and then, unloading said spray shield and said panel from said carrier.

* * * * *

UNITED STATES PATENT AND TRADEMARK OFFICE
CERTIFICATE OF CORRECTION

PATENT NO. : 4,729,907

DATED : March 8, 1988

INVENTOR(S) : Samuel B. Deal, Richard A. Lambert

It is certified that error appears in the above-identified patent and that said Letters Patent is hereby corrected as shown below:

Col. 2, line 38 and line 57 - after "coatings" add --of--.

Col. 7, claim 1, line 9 - after "carrier" add --and said guns being perpendicular to said panel--.

Claim 3, col. 8, line 1 - after "overcoating" delete "comprising a plurality of layers" and add --,--.

Signed and Sealed this

Nineteenth Day of July, 1988

*Attest:*

DONALD J. QUIGG

*Attesting Officer*

*Commissioner of Patents and Trademarks*